US006315844B1

(12) United States Patent
Ratz et al.

(10) Patent No.: US 6,315,844 B1
(45) Date of Patent: Nov. 13, 2001

(54) METHOD FOR PRODUCING HIGH-STRENGTH TRACK ELEMENT AND TRACK ELEMENT THUS OBTAINED

(75) Inventors: Gerhard Ratz, Langgöns-Oberkleen; Walter Kunitz, Wildau, both of (DE)

(73) Assignee: BWG Butzbacher Weichenbau Gesellschaft mbH & Co. KG, Butzbach (DE)

( * ) Notice: Subject to any disclaimer, the term of this patent is extended or adjusted under 35 U.S.C. 154(b) by 0 days.

(21) Appl. No.: 09/463,968

(22) PCT Filed: Aug. 6, 1998

(86) PCT No.: PCT/EP98/04894

§ 371 Date: Apr. 19, 2000

§ 102(e) Date: Apr. 19, 2000

(87) PCT Pub. No.: WO99/09222

PCT Pub. Date: Feb. 25, 1999

(30) Foreign Application Priority Data

Aug. 14, 1997 (DE) ..... 197 35 285

(51) Int. Cl.[7] ..... C21D 9/04

(52) U.S. Cl. ..... 148/581; 148/584

(58) Field of Search ..... 148/584, 581, 148/622, 624

(56) References Cited

U.S. PATENT DOCUMENTS

| | | | | |
|---|---|---|---|---|
| 4,933,024 | * | 6/1990 | Fukuda et al. | 148/12 |
| 5,482,576 | | 1/1996 | Heller et al. | 148/334 |
| 5,879,474 | | 3/1999 | Bhadeshia et al. | 148/333 |

FOREIGN PATENT DOCUMENTS 1239110 10/1965 (DE) .

* cited by examiner

*Primary Examiner*—George Wyszomierski
*Assistant Examiner*—Janelle Combs-Morillo
(74) *Attorney, Agent, or Firm*—Dennison, Scheiner, Schultz & Wakeman

(57) ABSTRACT

The invention relates to a high-strength steel track element, and process of making the steel track element by rolling and heat treating. The steel comprises: 0.3–0.6% C, 0.8–1.5% Si, 0.7–1.0% Mn, 0.9–1.4% Cr, 0.6–1.0% Mo, balance iron and smelting-related impurities. The steel has a bainitic basic structure, a tensile strength of at least 1600 N/mm$^2$ and a technical yield strength of at least 1250 N/mm$^2$.

10 Claims, No Drawings

METHOD FOR PRODUCING HIGH-STRENGTH TRACK ELEMENT AND TRACK ELEMENT THUS OBTAINED

The invention relates to a process for manufacture of a high-strength track section of steel, in particular of a switch section such as a frog, tongue rail or wing rail. The invention further relates to a switch section made of steel.

Due to the increasing speed of trains the requirements placed on the track super-structure are also increasing. Here it is rails and switches in particular that must have a high resistance to wear, crushing and fatigue damage. In addition, resistance to fracture and suitability for welding must be assured. These requirements were the reason for the use of rails with minimum tensile strengths of 1100 N/mm$^2$.

A track section and a process for manufacture thereof is known from EP 0 620 865 B1, which a vacuum-treated steel is used with 0.53 to 0.62% C, 0.1 to 0.25% Si, 0.65 to 1.1% Mn, 0.8 to 1.3% Cr, 0.05 to 0.11% Mo, 0.05 to 0.11% V, <0.02% P, optionally up to 0.025% Al, optionally up to 0.5% Nb, remainder iron and usual smelting-related impurities, with the ratio of Mn:Cr being around 0.80<Mn:Cr<0.85 and the ratio of Mo:V around 1, and with the track section in the form of a switch section being a rolled rail section as the starting material that has a martensitic structure at least in the rail head thanks to tempering and quenching. The result is strengths of over 1500 N/mm$^2$ in the rail head.

The literature source DE-Z: "Stahl und Eisen" magazine, 115 (1995), No. 2, pages 93–98, describes a process for manufacture of a natural-hardness bainitic rail with high tensile strength. A steel of as-rolled hardness is here subjected to a heat treatment such that firstly heating to 750° C. takes place, in order to then achieve a required bainitic structure by air cooling to below approx. 450° C. Then tempering over a period of one hour can take place at around 550° C. in order to then cool down the rail to room temperature. With the appropriate process, rail portions with a tensile strength of over 1400 N/mm$^2$ can be achieved.

The problem underlying the present invention is to develop a process for manufacture of a track section of the type mentioned at the outset or to develop a switch section itself such that a high tensile strength and yield strength are achieved and the useful life prolonged, so that in particular use in highly strained switches is possible. The problem is solved in accordance with the process in that steel with a chemical orientation analysis of 0.3 to 0.6% C, 0.8 to 1.5% Si, 0.7 to 1.0% Mn, 0.9 to 1.4% Cr, 0.6 to 1.0% Mo, remainder iron and usual smelting-related impurities, is after cooling from the rolling heat and formation of a bainitic basic structure with a tensile strength of approx. 1100 N/mm$^2$, first subjected to a pretreatment stage in that the steel with the bainitic basic structure is heated to a temperature $T_4$ of 400° C.<$T_4$ <550° C. and then cooled in controlled form in such a way that the steel has after the pretreatment a tensile strength of at least 1200 N/mm$^2$, then heated to a temperature $T_1$ with 750° C.<$T_1$<920° C., then cooled in accelerated form to a temperature $T_2$ with 450° C.<$T_2$<250° C. in a polymer/water mixture, in molten salt or in a powder, then heated up again to a temperature $T_3$>$T_2$ with 400° C.<$T_3$<560° C., kept at the temperature $T_3$ for a time $t_1$ of 60 mins.<$t_1$<150 mins., and then cooled to room temperature.

Particularly good results can be achieved when the steel is, after reaching the temperature $T_1$ at its core, kept there over a period $t_2$ with 10 mins.<$t_2$<30 mins., in particular $t_2$ in approx. 20 mins.

In particular, it is provided that the steel is, after a selective cooling from its rolling heat and formation of the bainitic basic structure with a tensile strength of approx. 1100 N/mm$^2$, heated to a temperature $T_1$ of in particular around 860° C., in order to then be cooled in accelerated form to the temperature $T_2$ and subjected to a cooling medium such that the steel is cooled at its core to the temperature $T_2$.

It is further provided that the steel with bianitic basic structure can be connected to standard rail steels such as 900 A and S 1100 by flash-butt welding, with the joined track sections then being able to be subjected to a joint heat treatment.

In accordance with the invention, a volume-tempering process of a steel with bainitic basic structure takes place, where selective heat treatment results without difficulty in tensile strengths of up to 1700 N/mm$^2$, yield strengths (technical yield strengths with 0.2% permanent elongation) of up to 1400 N/mm$^2$, breaking elongation A5 (%) of more than 10 and constrictions of more than 25%.

A switch section of steel, manufactured using previously described processes, is characterized in that the track section is made of steel with a chemical orientation analysis of 0.3 to 0.6% C, 0.8 to 1.5% Si, 0.7 to 1.0% Mn, 0.9 to 1.4% Cr, 0.6 to 1.0% Mo, remainder iron and usual smelting-related impurities, has a bianitic basic structure, a tensile strength of more than 1600 N/mm$^2$, a technical yield strength of more than 1250 N/mm$^2$, a breaking elongation>10% and a constriction>25%.

In particular, the steel has a chemical orientation analysis of 0.4 to 0.5% C, around 1% Si, around 0.8% Mn, around 1.0 Cr, and 0.6 to 1.0% Mo, the strength being up to 1700 N/mm$^2$ and the yield strength up to 1400 N/mm$^2$. In this case, the steel is heat-treated such that the breaking elongation is >10% and the constriction >25%.

Further details, advantages and features of the invention are shown not only in the claims and in the features they contain—singly and/or in combination—but also in the following description of embodiments.

The invention is explained in detail in the following using an example.

A steel with a chemical orientation analysis of 0.45% C, 1% Si, 0.8% Mn, 1.0 Cr, and 0.8% Mo, the remainder iron and usual smelting-related impurities, is shaped by rolling into a track section in order to achieve, by a selective cooling from the rolling heat, a structure with bianitic basic structure and a strength of approx. 1100 N/mm$^2$. The switch component then cooled down to room temperature is heated in a heat treatment oven to a temperature of approx. 500° C. in order to achieve by subsequent and further cooling a strength of 1300 to 1400 N/mm$^2$. Then the switch component is heated to approx. 860° C. Once this temperature is reached at the core of the switch component, accelerated cooling in a polymer/water mixture to above 350° C. takes place. Once this temperature has been reached in the core of the switch component, it is again heated to approx. 450° C., with the switch section being kept at this temperature for a period of about 2 hours. This heat treatment results in a tine-needle bainitic structure with the following properties:

| | |
|---|---|
| tensile strength | approx. 1680 N/mm$^2$ |
| technical yield strength | approx. 1350 N/mm$^2$ |
| breaking elongation | >10% |
| constriction | >25% |

A corresponding switch section is then jointed with a rail of grade UIC 900 A or UIS S 1100 by flash-butt welding and integrated into a track. Regular checks resulted in a high wear strength and an increase in the stability of about 50% in comparison with standard switch sections.

It should be mentioned that the renewed heating up to approx. 860° C. and the process steps then initiated are preferred measures.

What is claimed is:

1. A process for manufacturing a high strength track section of steel comprising the steps of:

providing a quantity of steel having a chemical composition of 0.3 to 0.6% C, 0.8 to 1.5% Si, 0.7 to 1.0% Mn, 0.9 to 1.4% Cr, 0.6 to 1.0% Mo, remainder iron and usual smelting-related impurities;

heating said steel to about 750° C.;

cooling said steel to below about 450° C. to produce a bainitic basic structure with a tensile strength of approximately 1100 $N/mm^2$;

heating said steel to a temperature $T_4$ where 400° C.<$T_4$<550° C.;

cooling said steel in a controlled way to produce a steel having a tensile strength of at least 1200 $N/mm^2$;

heating said steel to a temperature $T_1$ where 750° C.<$T_1$<920° C.;

cooling said steel in an accelerated form to a temperature $T_2$ where 250° C.<$T_2$<400° C. in a medium selected from the group consisting of a polymer/water mixture, a molten salt, and a powder;

heating said steel to a temperature $T_3$>$T_2$ where 400° C.<$T_3$<560° C.;

holding said steel at a temperature $T_3$ for a time $t_1$ where 60 minutes<$t_1$<150 minutes; and, cooling the steel to room temperature.

2. Process according to claim 1 wherein the step of cooling said steel in accelerated form from the temperature $T_1$ to the temperature $T_2$ comprises the additional step of placing said steel in an aluminum sump.

3. Process according to claim 1 including the additional step, after said steel has reached temperature $T_1$, of holding said steel at said temperature $T_1$ for a period $t_2$ where 10 minutes<$t_2$<30 minutes.

4. Process according to claim 1 including the additional step, after said steel has reached temperature $T_1$, of holding said steel at said temperature $T_1$ for a period $t_2$ where $t_2$ is equal to approximately 20 minutes.

5. Process according to claim 1 wherein the step of heating said steel to a temperature $T_1$ comprises the step of heating said steel to approximately 860° C. and wherein the step of cooling said steel in an accelerated manner to a temperature $T_2$ comprises the step of placing said steel in a cooling medium.

6. Process according to claim 1 wherein the step of cooling said steel to about 450° C. to produce a bainitic basic structure with a tensile strength of approxiamately 1100 $N/mm^2$ comprises the step of cooling said steel to about 450° C. to produce a structure with a tensile strength of between 1300 $N/mm^2$ and 1400 $N/mm^2$.

7. Process according to claim 1 including the additional steps of connecting said steel to standard rail steels by flash-butt welding and subjecting the joined steels to a heat treatment.

8. Process according to claim 1 wherein the chemical composition comprises 0.4 to 0.5% C, about 1% Si, about 0.8% Mn, about 1.0 Cr, and 0.6 to 1.0% Mo, remainder iron and usual smelting-related impurities.

9. Switch section of steel manufactured according to claim 1 wherein said steel has a bainitic basic structure, a tensile strength of more than 1600 $N/mm^2$, a technical yield strength of more than 1250 $N/mm^2$, a breaking elongation greater than 10% and a constriction greater than 25%.

10. Switch section of steel manufactured according to claim 9 wherein said steel has a tensile strength of up to 1700 $N/mm^2$ and a technical yield strenth of up to 1400 $N/mm^2$.

* * * * *